United States Patent [19]

Berlin, Jr.

[11] 4,262,178

[45] Apr. 14, 1981

[54] CALIBRATION MECHANISM FOR A PRESSURE SWITCH

[75] Inventor: Donald M. Berlin, Jr., McHenry, Ill.

[73] Assignee: Eaton Corporation, Cleveland, Ohio

[21] Appl. No.: 136,594

[22] Filed: Apr. 2, 1980

Related U.S. Application Data

[63] Continuation of Ser. No. 910,264, May 30, 1978, abandoned.

[51] Int. Cl.[3] ..... H01H 35/34

[52] U.S. Cl. ..... 200/81 R; 200/83 S; 200/83 WM; 403/353; 74/511 R

[58] Field of Search ..... 74/107, 568 R, 569, 74/504, 511 R; 200/83, 153 L, 153 LB, 251, 81 R; 337/117; 403/353; 292/341.15, 305, 306, 256.5, 333, 335; 220/298, 338, 342

[56] References Cited

U.S. PATENT DOCUMENTS

| | | | |
|---|---|---|---|
| 3,252,681 | 5/1966 | Watts | 403/353 |
| 3,846,600 | 11/1974 | Kolze | 200/83 S |
| 4,081,637 | 3/1978 | Stearley | 200/83 WM |
| 4,129,395 | 12/1978 | Theurer | 403/353 |

*Primary Examiner*—Gerald P. Tolin

*Attorney, Agent, or Firm*—R. J. McCloskey; E. C. Crist

[57] ABSTRACT

A calibration mechanism for a pressure switch of the type utilizing a rotary cam which controls the setting of a spring-biased plunger to establish pressure levels required to actuate the switch. The calibration mechanism includes a support bracket mounted on the switch and a cam assembly including an integrally formed cam member and camshaft. A plunger adjustment mechanism includes a pivotally mounted lever having a cam follower in following engagement with the cam. The support bracket defines a bore adapted to receive the camshaft. The cam has a range of rotational orientations in which the cam follower engages the operative portion of the cam profile. The camshaft includes a projection extending radially therefrom which is axially disposed from the cam a predetermined distance greater than the axial length of the bore in the support bracket. The support bracket defines a slot extending from the bore. The cam assembly is assembled to the support bracket by orienting the cam assembly relative to the bracket such that the projection on the camshaft passes through the slot as the camshaft is inserted in the bore. The cam assembly is then rotated to the operable range of angular displacement in which the projection is angularly offset from the slot, thus axially retaining the shaft of the cam assembly in the bore of the support bracket.

2 Claims, 7 Drawing Figures

CALIBRATION MECHANISM FOR A PRESSURE SWITCH

This is a continuation of application Ser. No. 910,264 filed May 30, 1978, now abandoned.

FIELD OF THE INVENTION

The present invention relates to calibration mechanisms of the cam-type such as are used for pressure switches and, more particularly, to an improved configuration of the camshaft and support bracket which simplifies and facilitates assembly of the mechanism.

DESCRIPTION OF THE PRIOR ART

Conventional actuation mechanisms for pressure switches such as illustrated in pending reissue application Ser. No. 737,293, filed Nov. 11, 1976, previously issued as U. S. Pat. No. 3,846,600 and assigned to the assignee of the present invention have utilized stamped metal support brackets, cams, plunger adjustment and cam follower mechanisms and metal camshafts. Typically, as in the mechanism of the above-cited patent, the camshaft is assembled with the support bracket, and then the cam member is placed on the projecting end of the camshaft which is then coined or staked to maintain the cam rigidly attached to the camshaft, which normally must be lubricated where it engages the support bracket. Although such actuation mechanisms have been generally satisfactory in operation, the necessity for lubricating the metal parts is undesirable from a processing standpoint, the manufacturing expense of the metal stampings and machined shaft is excessive, and the need to stake the cam to the shaft merely requires additional assembly steps and equipment, further diminishing the economic feasibility of the actuation mechanism.

The use of plastic moldings for the support bracket and cam assembly has been considered as a means of eliminating the need for lubrication, but until the present invention, the use of such plastic parts has not provided any particular advantage from the standpoint of the assembly process.

SUMMARY OF THE INVENTION

Accordingly, it is an object of the present invention to provide an actuation mechanism, such as is used for pressure switches, in which the assembly of the cam, camshaft and support bracket is greatly simplified and may be performed manually, without the need for expansive jigs, fixtures and assembly equipment such as staking presses.

It is a more specific object of the present invention to provide a calibration mechanism in which the configuration of the support bracket and camshaft are utilized to retain the cam assembly in its assembled position during normal operational rotation of the cam assembly.

The above and other objects of the present invention are accomplished by the provision of an improved calibration mechanism for controlling the setting of a spring-biased control member which includes a cam follower. The calibration mechanism comprises a support means defining an axial bore and a cam assembly including a cam member defining a cam profile and a camshaft adapted to be received in the bore and to permit the cam assembly to be rotatably disposed in an assembled position with the cam member axially-adjacent the support bracket. The cam assembly has a range of rotational orientations, when the cam assembly is in the assembled position, in which the cam follower is in following engagement with the cam profile. The cam assembly also has an assembly orientation, rotatably displaced from the range of rotational orientations. The camshaft has a projection extending radially therefrom, and axially spaced from the cam member, and the support bracket defines a slot in communication with the bore. During assembly, the slot is circumferentially oriented to receive the projection when the cam assembly is in the assembly orientation and permits the projection to pass axially therethrough as the cam assembly is moved axially to the assembled position. The support bracket and slot are configured to permit rotations of the cam assembly, when the cam assembly is in the assembled position, to the range of rotational orientations. In this condition, the projection is out of circumferential alignment with the slot and prevents substantial axial movement of the cam assembly.

A second embodiment of the invention incorporates an actuator arm having a bore and a slot communicating therewith for receiving the camshaft and projection. The actuator arm also defines a radial projection circumferentially and axially aligned with the projection on the camshaft. The actuator arm is spring-biased to a predetermined angular position with respect to the support bracket in which the projection on the shaft is disengaged from the projection on the actuator arm and also angularly offset from the actuator arm slot. After the cam assembly has rotated through a portion of its total angular displacement, the shaft projection then engages the actuator arm projection and rotates it through a given angular displacement. Throughout the complete range of camshaft angular displacement the shaft projection remains in abutment with a transverse shoulder adjacent the bore in the actuator arm, thereby axially retaining the camshaft to the support bracket.

DETAILED DESCRIPTION

Figure 1:
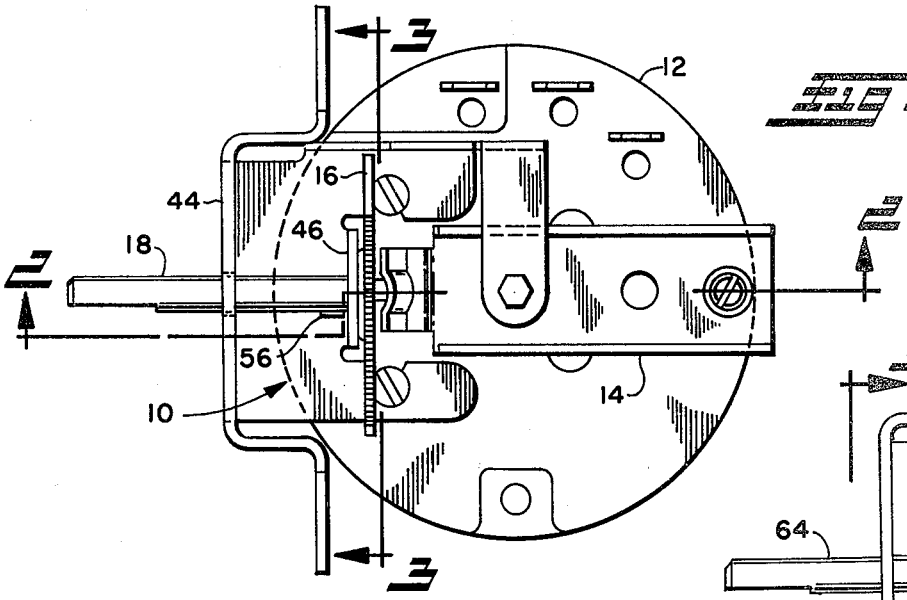
FIG. 1 is a top plan view of the calibration mechanism of the present invention.
Figure 2:
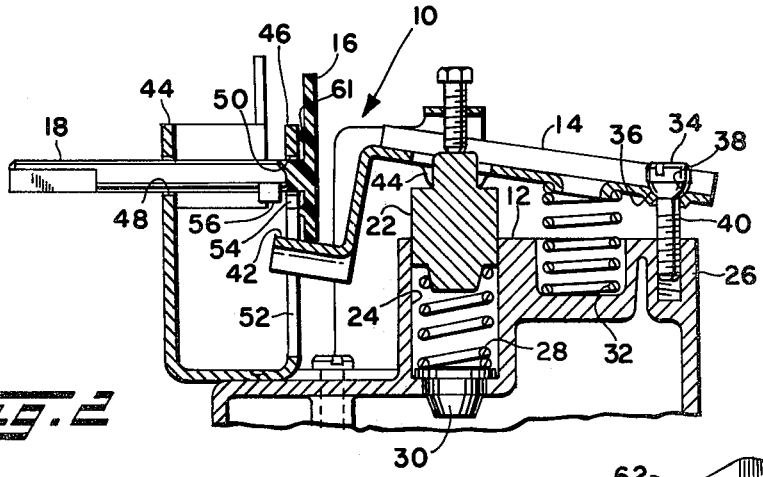
FIG. 2 is a cross-sectional view of the calibration mechanism taken on section lines 2—2 of FIG. 1.

Referring now to FIGS. 1 and 2, there is shown generally by reference numeral 10 a calibration mechanism mounted on a pressure switch 12. The calibration mechanism 10 includes a pivotally mounted lever 14, a cam member 16, a camshaft 18, and a support bracket indicated generally by reference numeral 20. The pressure switch 12, forming no part of this invention, includes a spring-biased plunger 22 slidably received in a bore 24 formed in an upper housing section 26 of pressure switch 12. As shown in FIG. 2, a biasing spring 28 has its upper end reacting against the bottom surface of plunger 22 and its bottom end reacting against the top surface of an actuator member 30. A switch blade (not shown) is disposed intermediate the bottom surface of actuator 30 and the top surface of a diaphragm (not shown). The diaphragm is responsive to pressures developed by varying water levels. A second biasing spring 32 is mounted between upper housing 26 and lever 14 and functions to continuously maintain an upward biasing force upon the lever 14. Lever 14 is pivotally mounted at its right end by a fastener 34 having a spherical head 36 which seats against a corresponding spherical follicle 38 having a central opening 40 through which fastener 34 is received. A cam follower 42 is formed by the left end of lever 14 and is continuously biased against cam 16 by spring 32 and, during a portion of its pivotal movement, by spring 28. A pair of downwardly extending tabs 44 engage the top surface of plunger 22.

Support bracket 20 includes outer and inner vertical legs 44 and 46, having bores 48 and 50, respectively, which are horizontally aligned and also in line with a central longitudinal axis through lever 14. Inner vertical leg 46 includes a vertically extending slot 52 having cam follower 42 extending therethrough. Slot 52 functions to guide the pivotal motion of lever 14. A keyhole slot 54 is aligned with slot 52 and communicates with bore 50.

A radially extending projection 56 is formed on camshaft 18 and has a width permitting entry through keyhole slot 54. The right transverse edge of projection 56 with respect to FIG. 2 is spaced from the face of cam 16 a predetermined amount in order to establish desired camshaft end play with respect to bracket 20. In the preferred practice of the invention, cam 16, projection 56 and camshaft 18 are integrally molded in one piece from a suitable plastic material. This feature of the invention eliminates the need for lubricating the camshaft and cam member. A material found to be particularly suitable is marketed under the trademark "ZYTEL" by E. I. du Pont de Nemours, Wilmington, Delaware.

Figure 3:
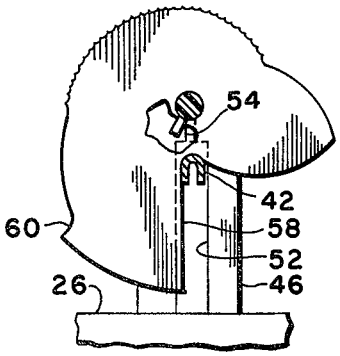
FIG. 3 is a partial view taken along section lines 3—3 of FIG. 1.

As illustrated in FIG. 3, cam member 16 defines first and second radially extending stop surfaces 58 and 60, respectively, which abut the sides of cam follower 42 and function to limit the angular displacement of camshaft 18. A circular bead 61 is formed on the transverse face of cam member 16 and provides a bearing surface for contacting against inner leg 46. Projection 56 is angularly positioned within that portion of the cam profile between stop surfaces 58 and 60 not contacted by follower 42. Keyhole slot 54, aligned with follower 42, remains continuously offset from projection 56. By maintaining projection 56 angularly offset from keyway slot 54, camshaft 18 is axially retained in bore 50 with inner vertical leg 46 being captured between projection 56 and cam 16. End play of camshaft 18 can therefore be determined by establishing the axial space between projection 56 and the face of cam 16 to an amount slightly greater than the thickness of inner vertical leg 46.

The calibration mechanism is assembled by first aligning projection 56 with keyhole slot 54 and inserting camshaft 18 through bores 50 and 48 of support bracket 20 until projection 56 clears slot 54. Support bracket 20 with the camshaft mounted therein is then attached to the upper housing section 26 of the pressure switch. Lever 14 is then aligned over plunger 22 and biasing spring 32 so that cam follower 42 extends into slot 52 and engages with the cam profile of cam section 16. Fastener 34 is then inserted through opening 40 in lever 14 and threaded into upper housing section 26. Cam follower 42 is now continuously in engagement with cam 16, thereby limiting the total angular displacement of the cam to an angle defined between first and second stop positions 58 and 60.

Figure 4:
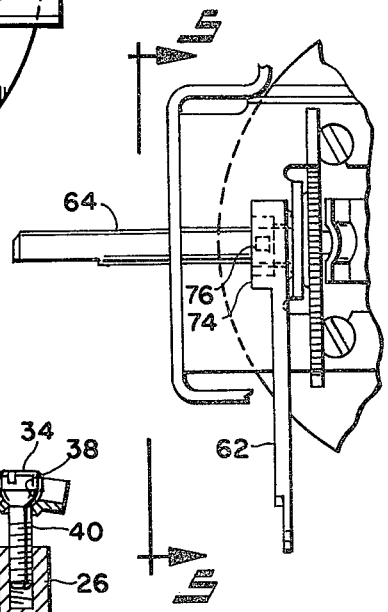
FIG. 4 is a partial top plan view of a second embodiment of the invention.
Figure 5:
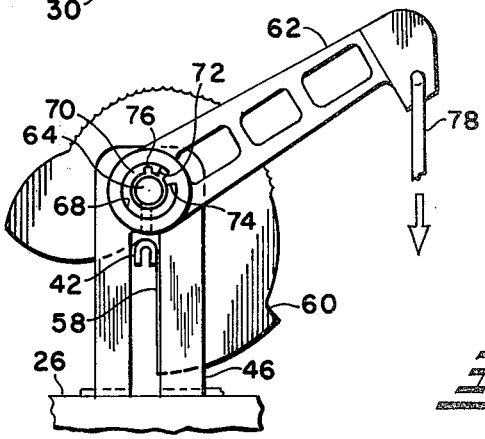
FIG. 5 is a partial end view taken along section lines 5—5 of FIG. 4.
Figure 6:
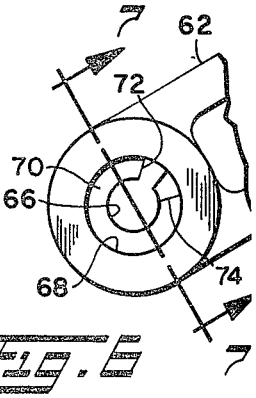
FIG. 6 is an enlarged partial view of the actuator arm.
Figure 7:
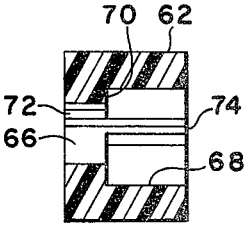
FIG. 7 is a cross-sectional view taken along section lines 7—7 of FIG. 6.

Referring now to FIG. 4, there is shown a second embodiment of the invention which includes an actuator arm 62 rotatably mounted on camshaft 64 through a bore 66. As best shown in FIGS. 6 and 7, actuator arm 62 includes a counterbore 68 which terminates in a transverse shoulder 70. A slot 72 extends axially through shoulder 70 and permits projection 76 to pass therethrough. A projection 74 extends inward radially from bore 68. As illustrated in FIG. 5, camshaft 64 has a radial projection 76 extending therefrom an amount sufficient to clear bore 68 when the actuator arm is positioned on camshaft 64. As illustrated in FIG. 4, the actuator arm projection 74 and the camshaft projection 76 are axially aligned. Actuator arm 62 is biased in the position as shown by FIG. 5 and has a connecting linkage 78 attached to its free end with the other end of the linkage (not shown) connected to an associated appliance control member. With the actuator arm biased to the position as shown in FIG. 5 and with stop surface 58 abutting follower 42, camshaft 64 can only rotate initially in a counterclockwise direction. Continued counterclockwise rotation of camshaft 64 results in projection 76 rotating away from slot 72 until it abuts projection 74. Further rotation of cam shaft 64 is then effective to rotate actuator arm 62 counterclockwise for the remaining portion of cam displacement until stop surface 60 abuts follower 42. Shoulder 70 prevents projection 76 from passing through keyhole slot 72 (identical to first embodiment) as it rotates past alignment therewith. By maintaining projection 76 offset from slot 72 and in axial abutment with shoulder 70, the actuator arm 62 and camshaft 64 are axially retained to the support bracket.

The second embodiment of the invention is assembled in a manner identical to that described for the first embodiment wherein projection 76 is aligned with slot 52 of the support bracket and actuator arm 62 is rotated to permit projection 76 to pass through slot 72. The support bracket is then attached to the pressure switch following assembly of lever 14.

Modifications and variations of the preferred embodiment will occur to others upon a reading of the specification, and it is my intention to include all such modifications and alterations insofar as they come within the scope of the appended claims.

What is claimed is:

1. An adjustment assembly in a pressure switch having a spring-biased plunger arrangement and a pivotally mounted lever operably connected to said plunger for adjusting the position of said plunger, comprising:

(a) bracket means mounted to said pressure switch, said bracket means including a mounting member having a bore therethrough;

(b) cam means including, (i) a cam member having first and second stop surfaces, (ii) a shaft connected to said cam member, (iii) a lobed portion extending radially from said shaft and axially spaced from said cam member a predetermined amount, said lobed portion being angularly offset from the angular displacement defined between said first and second stop surfaces, said cam member, said shaft, and said lobed portion are an integral one-piece assembly;

(c) said mounting member having a radially extending slot opening to said bore and having said shaft and said lobed portion receivable therethrough; and (d) said lever having one end thereof engaging said cam member as a follower for limiting rotation thereof between said first and second stop surfaces, said spring-biased plunger engaging said lever intermediate the ends thereof for movement therewith, said cam member being operative while engaging said lever follower end to maintain said lobed portion angularly offset with respect to said slot, said lobed portion, and said cam member, thereby axially retaining said cam means to said mounting member.

2. An adjustment assembly in a pressure switch having a spring-biased plunger arrangement, adjustable by a pivotally mounted lever, comprising:

(a) bracket means mounted to said pressure switch, said bracket means including a mounting member having a bore therethrough;

(b) cam means including, (i) a cam member rotatable between first and second stop positions, (ii) a shaft connected to said cam member, (iii) a lobed portion extending radially from said shaft and axially spaced from said cam member a predetermined amount, said lobed portion being angularly offset from the angular displacement defined between said first and second stop positions;

(c) said mounting member having a radially extending slot opening to said bore and having said shaft and said lobed portion received therethrough; and (d) said lever having one end thereof engaging said cam means as a follower for limiting rotation thereof between said first and second stop positions, said spring-biased plunger engaging said lever intermediate the ends thereof for movement therewith, said cam member being operative while engaging said lever follower end to maintain said lobed portion angularly offset with respect to said slot, said lobed portion, and said cam member, for axially retaining said cam assembly to said mounting member; and (e) an actuator arm having a bore therein with said shaft received therethrough and mounted for rotation about said shaft, said actuator arm defining a slot extending radially outwardly from said bore for permitting said lobed portion of said shaft to extend therethrough, said actuator arm including an abutment member circumferentially aligned with said lobed portion for engagement therewith, whereupon rotation of said shaft by a predetermined amount, said lobed portion of said shaft moves circumferentially relative to said bore in said actuator arm and said actuator arm remains stationary with respect to said bracket means, whereupon rotation of said shaft beyond said predetermined amount said lobed portion engages with abutment member and said actuator arm is rotated, said lobed portion being angularly displaced from said actuator arm slot for axially retaining said actuator arm on said shaft.

* * * * *